US005915839A

United States Patent [19]

Dennis

[11] Patent Number: 5,915,839

[45] Date of Patent: Jun. 29, 1999

[54] DUST BAG

[76] Inventor: Hugh A. Dennis, 10 Haslemere Avenue, East Barnet, Herts, London, United Kingdom, EN4 8EZ

[21] Appl. No.: 09/015,083

[22] Filed: Jan. 29, 1998

[51] Int. Cl.[6] ..... B65D 33/14

[52] U.S. Cl. ..... 383/11; 383/33; 383/120

[58] Field of Search ..... 383/11, 33, 120

[56] References Cited

U.S. PATENT DOCUMENTS

| | | | |
|---|---|---|---|
| 3,426,958 | 2/1969 | Gore | 383/11 |
| 3,561,670 | 2/1971 | Segal | 383/11 |
| 3,578,236 | 5/1971 | Arai | 383/33 |
| 3,589,595 | 6/1971 | White | 383/11 |
| 4,328,895 | 5/1982 | Jaeger | 383/11 X |
| 4,335,769 | 6/1982 | McManus | 383/11 |

FOREIGN PATENT DOCUMENTS

| | | | |
|---|---|---|---|
| 2250975 | 6/1992 | United Kingdom | 383/11 |

*Primary Examiner*—Jes F. Pascua

[57] ABSTRACT

A dust collection system is provided including a generally vertical recipient surface. A bag is provided with a coupling mechanism mounted thereto for releasably coupling with the recipient surface thereby catching dust from a hole being drilled thereabove.

2 Claims, 2 Drawing Sheets

DUST BAG

BACKGROUND OF THE INVENTION

1. Field of the Invention

The present invention relates to dust collection systems and more particularly pertains to a new dust bag for collecting dust from a hole being drilled.

2. Description of the Prior Art

The use of dust collection systems is known in the prior art. More specifically, dust collection systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art dust collection systems include U.S. Pat. No. 5,419,663; U.S. Pat. No. 5,160,230; U.S. Pat. No. 3,938,283; U.S. Pat. No. 4,998,694; U.S. Pat. No. 4,139,037; and U.S. Pat. Des. 330,852.

In these respects, the dust bag according to the present invention substantially departs from the conventional concepts and designs of the prior art, and in so doing provides an apparatus primarily developed for the purpose of collecting dust from a hole being drilled.

SUMMARY OF THE INVENTION

In view of the foregoing disadvantages inherent in the known types of dust collection systems now present in the prior art, the present invention provides a new dust bag construction wherein the same can be utilized for collecting dust from a hole being drilled.

The general purpose of the present invention, which will be described subsequently in greater detail, is to provide a new dust bag apparatus and method which has many of the advantages of the dust collection systems mentioned heretofore and many novel features that result in a new dust bag which is not anticipated, rendered obvious, suggested, or even implied by any of the prior art dust collection systems, either alone or in any combination thereof.

To attain this, the present invention generally comprises a front and rear face each having a planar square configuration with a top edge, a bottom edge and a pair of side edges. The bottom edge of the front face is integrally coupled to the bottom edge of the rear face. FIG. 1 shows a pair of triangular side faces each having a pair of side edges. Such side edges are integrally coupled between a corresponding one of the side edges of both the front face and the rear face. The top edges of the side faces are in coplanar relationship with those of the front and rear face. Each side face has a vertically oriented perforation formed along a bisecting line thereof. As such, the front and rear face may be pivoted along an axis coincident with the bottom edges thereof. Such pivoting renders both an open orientation and a closed orientation. As shown in FIG. 3, an adhesive strip having a rectangular configuration is provided. The adhesive strip is situated between the sides edges of an outer surface of the rear face adjacent to the top edge thereof. By this structure, the rear face may be mounted to a vertical recipient surface in coplanar relationship therewith. Further, the bag may be transferred to the open orientation below a spot where drilling is to take place. Finally, a deformable closed loop wire is mounted to an interior surface of each of the faces a predetermined distance from the top edges thereof. The wire serves to maintain the bag in the open orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dust bag apparatus and method which has many of the advantages of the dust collection systems mentioned heretofore and many novel features that result in a new dust bag which is not anticipated, rendered obvious, suggested, or even implied by any of the prior art dust collection systems, either alone or in any combination thereof.

It is another object of the present invention to provide a new dust bag which may be easily and efficiently manufactured and marketed.

It is a further object of the present invention to provide a new dust bag which is of a durable and reliable construction.

An even further object of the present invention is to provide a new dust bag which is susceptible of a low cost of manufacture with regard to both materials and labor, and which accordingly is then susceptible of low prices of sale to the consuming public, thereby making such dust bag economically available to the buying public.

Still yet another object of the present invention is to provide a new dust bag which provides in the apparatuses and methods of the prior art some of the advantages thereof, while simultaneously overcoming some of the disadvantages normally associated therewith.

Still another object of the present invention is to provide a new dust bag for collecting dust from a hole being drilled.

Even still another object of the present invention is to provide a new dust bag that includes a generally vertical recipient surface. A bag is provided with a coupling mechanism mounted thereto for releasably coupling with the recipient surface thereby catching dust from a hole being drilled thereabove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
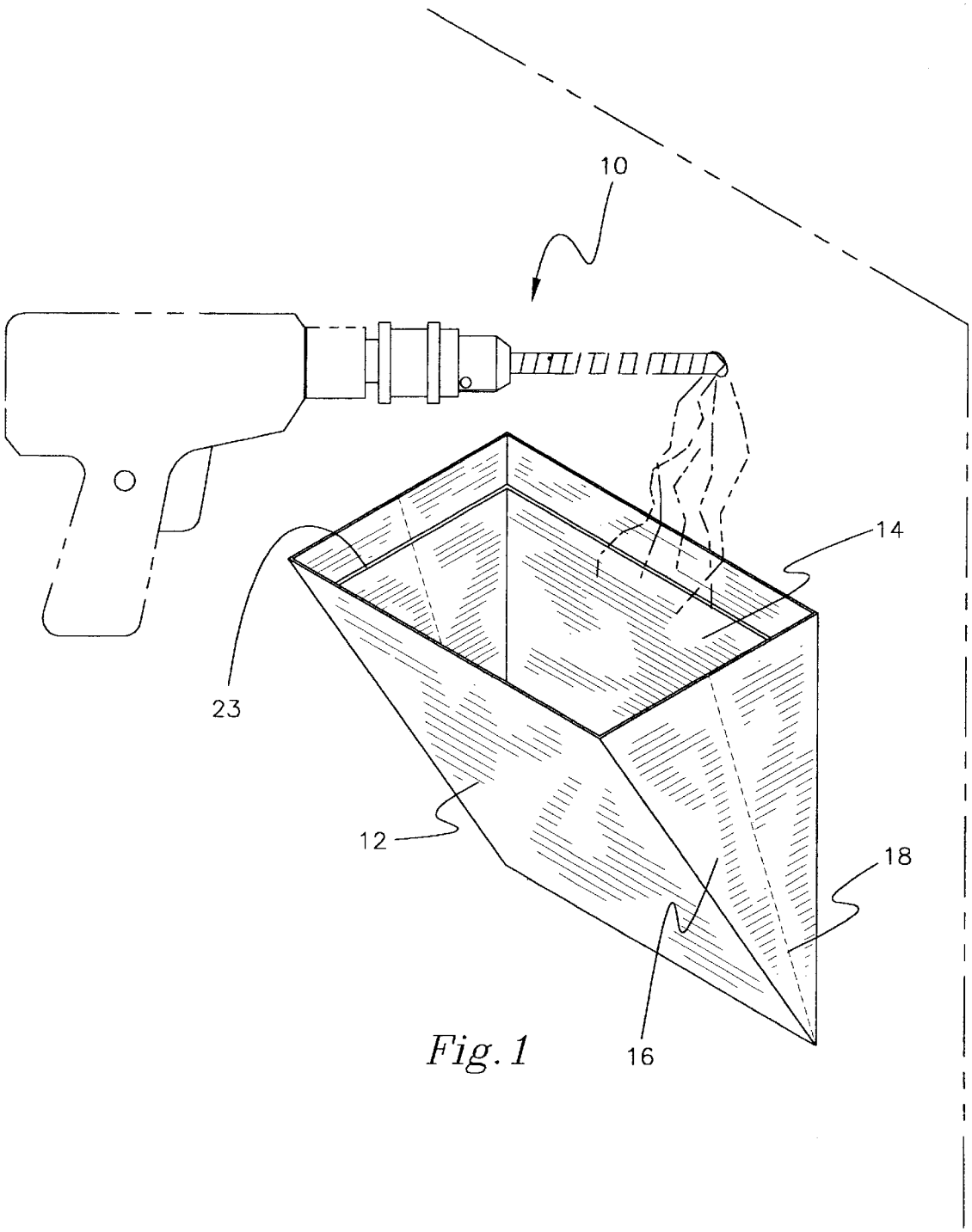
FIG. 1 is a perspective view of a new dust bag according to the present invention.
Figure 2:
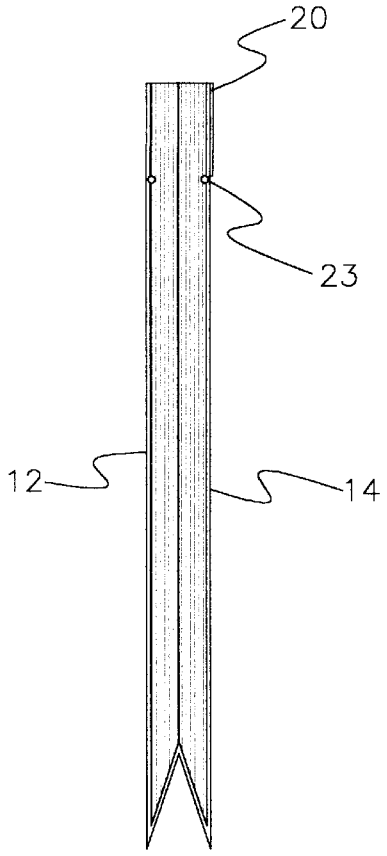
FIG. 2 is a side cross-sectional view of the present invention taken along line 2—2 shown in FIG. 3.

With reference now to the drawings, and in particular to FIGS. 1 through 4 thereof, a new dust bag embodying the principles and concepts of the present invention and generally designated by the reference numeral 10 will be described.

The present invention, designated as numeral 10, includes a front and rear face 12 & 14 each having a planar square configuration with a top edge, a bottom edge and a pair of side edges. The bottom edge of the front face is integrally coupled to the bottom edge of the rear face.

FIG. 1 shows a pair of triangular side faces 16 each having a pair of side edges. Such side edges are integrally coupled between a corresponding one of the side edges of both the front face and the rear face. The top edges of the side faces are in coplanar relationship with those of the front and rear face. Each side face has a vertically oriented perforation 18 formed along a bisecting line thereof. As such, the front and rear face may be pivoted along an axis coincident with the bottom edges thereof. Such pivoting renders both an open orientation and a closed orientation. Preferably, the faces of the bag are constructed from a semi-rigid, resilient material such a cardboard, any other paper product or the like. In the alternative, plastic may be used to construct the bag. In terms of size, the bag preferably has a length of 250 mm and a length of 200 mm.

Figure 3:
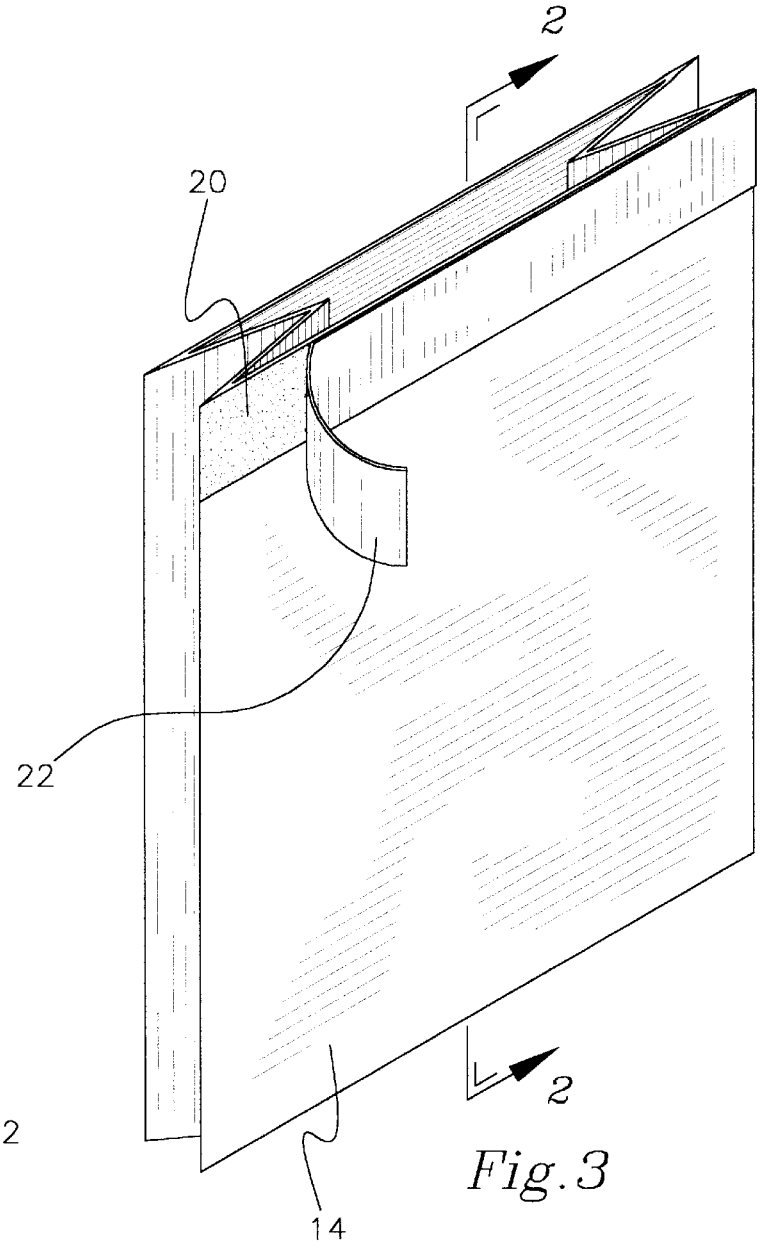
FIG. 3 is a perspective view of the present invention.
Figure 4:
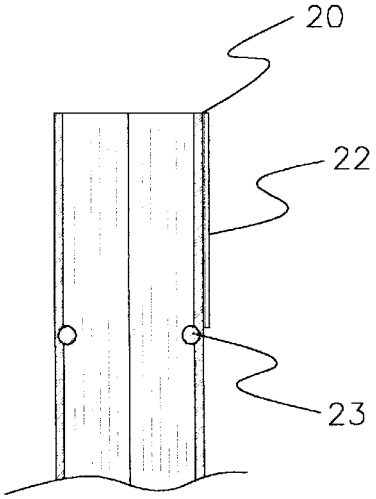
FIG. 4 is another cross-sectional view of the present invention showing the wire loop therein.

As shown in FIG. 3, an adhesive strip 20 having a rectangular configuration is provided. The adhesive strip is situated between the sides edges of an outer surface of the rear face adjacent to the top edge thereof. By this structure, the rear face may be mounted to a vertical recipient surface in coplanar relationship therewith. Further, the bag may be transferred to the open orientation below a spot where drilling is to take place. It should be noted that the height of the adhesive strip is less than 1/10 that of the bag. Further, a waxed paper backing 22 is preferably provided to preserve the adhesive prior to use.

Finally, a deformable closed loop wire 23 is mounted to an interior surface of each of the faces a constant predetermined distance from the top edges thereof. The wire serves to maintain the bag in the open orientation. During use, the entire length of the wire always remains in contact with the associated face. Further, when the bag is opened, the wire is maintained in a rectangular configuration.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dust collection bag comprising, in combination:

a front and rear face each having a planar square configuration with a top edge, a bottom edge and a pair of side edges, the bottom edge of the front face being integrally coupled to that of the rear face;

a pair of triangular side faces each having a pair of side edges integrally coupled between a corresponding one of the side edges of both the front face and the rear face, wherein top edges of the side faces are in coplanar relationship with those of the front and rear face, each side face having a vertically oriented perforation formed along a bisecting line thereof, whereby the front and rear face may be pivoted along an axis coincident with the bottom edges thereof between an open orientation and a closed orientation;

an adhesive strip having a rectangular configuration and situated between the sides edges of an outer surface of the rear face adjacent to the top edge thereof, whereby the rear face may be mounted to a vertical recipient surface in coplanar relationship therewith and the bag transferred to the open orientation below a spot where drilling is to take place; and a deformable closed loop wire mounted to an interior surface of each of the faces a predetermined distance from the top edges thereof for maintaining the bag in the open orientation.

2. A dust collection bag comprising, in combination:

a front and rear face each having a top edge, a bottom edge and a pair of side edges, the bottom edge of the front face being integrally coupled to that of the rear face;

a pair of substantially triangular side faces each having a pair of side edges integrally coupled between a corresponding one of the side edges of both the front face and the rear face, wherein top edges of the side faces are in substantially coplanar relationship with those of the front and rear face, each side face having a substantially vertically oriented perforation formed along a bisecting line thereof, whereby the front and rear face may be pivoted along an axis coincident with the bottom edges thereof between an open orientation and a closed orientation;

an adhesive strip situated between the sides edges of an outer surface of the rear face adjacent to the top edge thereof, whereby the rear face may be mounted to a vertical recipient surface in coplanar relationship therewith and the bag transferred to the open orientation below a spot where drilling is to take place; and a deformable closed loop wire mounted to the faces a predetermined distance from the top edges thereof for maintaining the bag in the open orientation.

* * * * *